US007340924B2

(12) United States Patent
Kim et al.

(10) Patent No.: US 7,340,924 B2
(45) Date of Patent: Mar. 11, 2008

(54) GASKET AND WASHING MACHINE USING THE SAME

(75) Inventors: Gon Kim, Jinhae-si (KR); Yu Beom Kang, Changwon-si (KR); Sang Man Je, Koje-si (KR)

(73) Assignee: LG Electronics Inc., Seoul (KR)

( * ) Notice: Subject to any disclaimer, the term of this patent is extended or adjusted under 35 U.S.C. 154(b) by 528 days.

(21) Appl. No.: 10/722,426

(22) Filed: Nov. 28, 2003

(65) Prior Publication Data

US 2004/0107743 A1 Jun. 10, 2004

(30) Foreign Application Priority Data

Nov. 29, 2002 (KR) ..... 10-2002-0075319

(51) Int. Cl.

| | |
|---|---|
| ***B08B 3/12*** | (2006.01) |
| ***D06F 37/00*** | (2006.01) |
| ***D06F 29/00*** | (2006.01) |
| ***D06F 35/00*** | (2006.01) |
| ***D06F 15/00*** | (2006.01) |

(52) U.S. Cl. ..... 68/23 A; 68/5 D; 68/24; 68/36

(58) Field of Classification Search ..... 68/5 E, 68/24, 23 A, 36

See application file for complete search history.

(56) References Cited

U.S. PATENT DOCUMENTS 6,256,823 B1 * 7/2001 Kronbetter et al. ..... 8/158
2004/0025544 A1 * 2/2004 Kim et al. ..... 68/3 R

* cited by examiner

*Primary Examiner*—Michael Barr
*Assistant Examiner*—Rita R Patel
(74) *Attorney, Agent, or Firm*—Birch, Stewart, Kolasch & Birch, LLP

(57) ABSTRACT

Disclosed is a drum type washing machine having a gasket blocking a gap between a laundry entrance and a tub to prevent particles from being put therein. The present invention includes a cabinet having a first opening through which a laundry is put in, a tub having a second opening at a tub front side, a drum provided in the tub to have a third opening at a drum front side corresponding to the second opening, a rotation mans having a rotational shaft penetrating a rear side of the tub to be connected to the drum, a door opening/closing the first opening, and a gasket blocking a gap between the first and second openings to prevent leakage of water and blocking a gap between the second and third openings to prevent a particle from being put between the tub and the drum.

18 Claims, 6 Drawing Sheets

GASKET AND WASHING MACHINE USING THE SAME

This application claims the benefit of Korean Application(s) No. 10-2002-0075319 filed on Nov. 29, 2002, which is/are hereby incorporated by reference.

BACKGROUND OF THE INVENTION

1. Field of the Invention

The present invention relates to a washing machine, and more particularly, to a drum type washing machine having a gasket blocking a gap between a laundry entrance and a tub to prevent particles from being put therein.

2. Discussion of the Related Art

Generally, a washing machine holds water and detergent in a lower part of a tub. After laundry is put in a drum installed inside the tub, the drum is rotated to perform washing, rinsing, and dewatering.

Such a washing machine is an apparatus for eliminating dirt or filth attached to the laundry by applying a mechanical force thereto together with a detergent.

Specifically, a drum type washing machine is an apparatus for eliminating dirt or filth attached to the laundry by putting the laundry, water, and detergent in a drum horizontally installed to rotate by a driving force of a motor. The drum type washing machine barely has entanglement and damage of the laundry, consumes less water, and even has washing effects of beating and rubbing.

FIG. 1 is a perspective view of a general drum type washing machine, FIG. 2 is a schematic internal view of a general drum type washing machine, and FIG. 3 is a magnified view of 'A' in FIG. 2.

Referring to FIG. 1 and FIG. 2, a general drum type washing machine consists of a cabinet 10 forming an exterior to have a first opening 11 at a front side to put in/out a laundry, a door 12 installed in front of the cabinet 10 to open/close the first opening 11, a tub 20 provided inside the cabinet 10 to have a second opening 21 communicating with the first opening 11, and a drum 50 rotatably installed inside the tub 20 to have a third opening 50*a* communicating with the first opening 11.

And, the drum 50 includes lifters 25 on its inside to pull the laundry up to a predetermined height. Once the drum rotates, the laundry is lifted up to an upper part of the drum by the lifters and then falls down for washing.

A rotational means for rotating the drum is provided in a space between an inside of the cabinet and the tub 20.

The rotational means consists of a motor 40 provided under the tub to be electrically driven, a first rotational shaft 41 extending in a rear direction of the cabinet to have one end connected to the motor 40, a driving pulley 42 provided at the other end of the first rotational shaft 41, a second rotational shaft 43 having one end connected to a rear side of the drum, a driven pulley 44 provided at the other end of the second rotational shaft 43, and a belt 45 connecting the driving and driven pulleys 42 and 44.

A rotational force of the motor enabling forward and reverse rotations is transferred to the drum via the two rotational shafts, driving pulley, belt, and driven pulley.

Meanwhile, a water supply hose 16 and a water supply valve (not shown in the drawing) for supplying water and detergent to the tub 20 and a detergent box 17 are installed in an upper side of the cabinet 10. And, a drain pump 18 and a drain hose 19 for circulating or draining the water are installed under the tub 20.

And, a control panel 15 provided as a control means for controlling an operation of the drum type washing machine is installed on an upper front side of the cabinet 10.

Moreover, a gasket 50 is provided between the first and second openings 11 and 21 to buffer shocks generated from forward and reverse vibrations of the drum and to prevent leakage of the water when the drum is rotating with the door closed.

Referring to FIG. 3, the gasket 50 consists of a front end coupling part 51 enclosing the first opening 11 to be coupled with the first opening, a rear end coupling part 52 enclosing the second opening 21 to be coupled with the second opening 21, and a middle connecting part 53 of a flexible material connecting the front and rear end coupling parts 51 and 52.

The middle connecting part 53 consists of a first connecting member 53*a* having one end connected to the front end coupling part 51 to horizontally extend toward the tub, a second connecting member 53*b* having one end connected to the other end of the first connecting member 53*a* to radially extend toward the front side of the cabinet, and a third connecting member 53*c* having one end connected to the other end of the second connecting member 53*b* and having the other end connected to the rear end coupling part 52.

Thus, the middle connecting part 53 is bent to prevent shocks from appearing on the cabinet due to vibrations of the drum and tub when the washing machine is operating.

And, the middle connecting part 53 further consists of a ring type protrusion 54 protruding from its inside to cut off a predetermined portion of a gap between the second and third openings 21 and 50*a*.

The protrusion 54 leaves a predetermined distance d1 from the third opening 50*a* to prevent the damage or breakdown of the drum undergoing friction with the third opening 50*a* by the rotational vibration of the rotating drum 50.

In the general drum type washing machine having the above-constructed gasket, the gap between the second and third openings 21 and 50*a* is considerably wide, whereby particles such as coins and the like may enter the gap during washing, rinsing, or dewatering to break down the washing machine.

To overcome such a problem, a new drum type washing machine enabling to prevent the particles from entering the gap is needed.

SUMMARY OF THE INVENTION

Accordingly, the present invention is directed to a gasket and drum type washing machine using the same that substantially obviates one or more of the problems due to limitations and disadvantages of the related art.

An object of the present invention, which has been devised to solve the foregoing problem, lies in providing a gasket and drum type washing machine using the same, by which particles are prevented from being put between a tub and a drum in a cabinet.

It is another object of the present invention to provide a gasket and drum type washing machine using the same, by which no damage is caused by vibration generated from rotating a drum.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided, in a washing machine including a cabinet having a first opening through which a laundry is put in, a tub having a second opening at a tub front side, and a drum rotatably provided in the tub to have a third opening at a drum front side, a gasket according to the present invention includes a leakage preventing part having one end connected to a rim of the first opening and the other end connected to a rim of the second opening and a ring type protrusion protruding toward a center between the one and the other ends of the leakage preventing part to block a gap between the second and third openings.

The protrusion extends to a front end of the third opening from an inside of the leakage preventing part.

An inside diameter of the second opening is greater than that of the third opening.

Moreover, the second opening is formed ahead of the third opening.

And, an inside diameter of a front end of the protrusion is smaller than that of a rear end of the protrusion.

In this case, the inner side diameter of the front end of the protrusion is equal to an outside diameter of the third opening.

The inner side diameter of the front end of the protrusion can be formed greater than the outside diameter of the third opening.

And, the inner side diameter of the rear end of the protrusion is smaller than the inside diameter of the third opening.

In another aspect of the present invention, there is provided a drum type washing machine includes a cabinet having a first opening through which a laundry is put in, a tub having a second opening at a tub front side, a drum provided in the tub to have a third opening at a drum front side corresponding to the second opening, a rotation mans having a rotational shaft penetrating a rear side of the tub to be connected to the drum, a door opening/closing the first opening, and a gasket blocking a gap between the first and second openings to prevent leakage of water and blocking a gap between the second and third openings to prevent a particle from being put between the tub and the drum.

The gasket includes a leakage preventing part having one end enclosing a rim of the first opening and the other end enclosing a rim of the second opening and a ring type protrusion protruding toward a center between the one and the other ends of the leakage preventing part to block the gap between the second and third openings.

The protrusion extends to a front end of the third opening from an inside of the leakage preventing part.

Therefore, the above-constructed drum type washing machine according to the present invention enables to prevent water leakage from taking place in operating the washing machine and to prevent particles from being stuck between the tub and drum in the cabinet.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
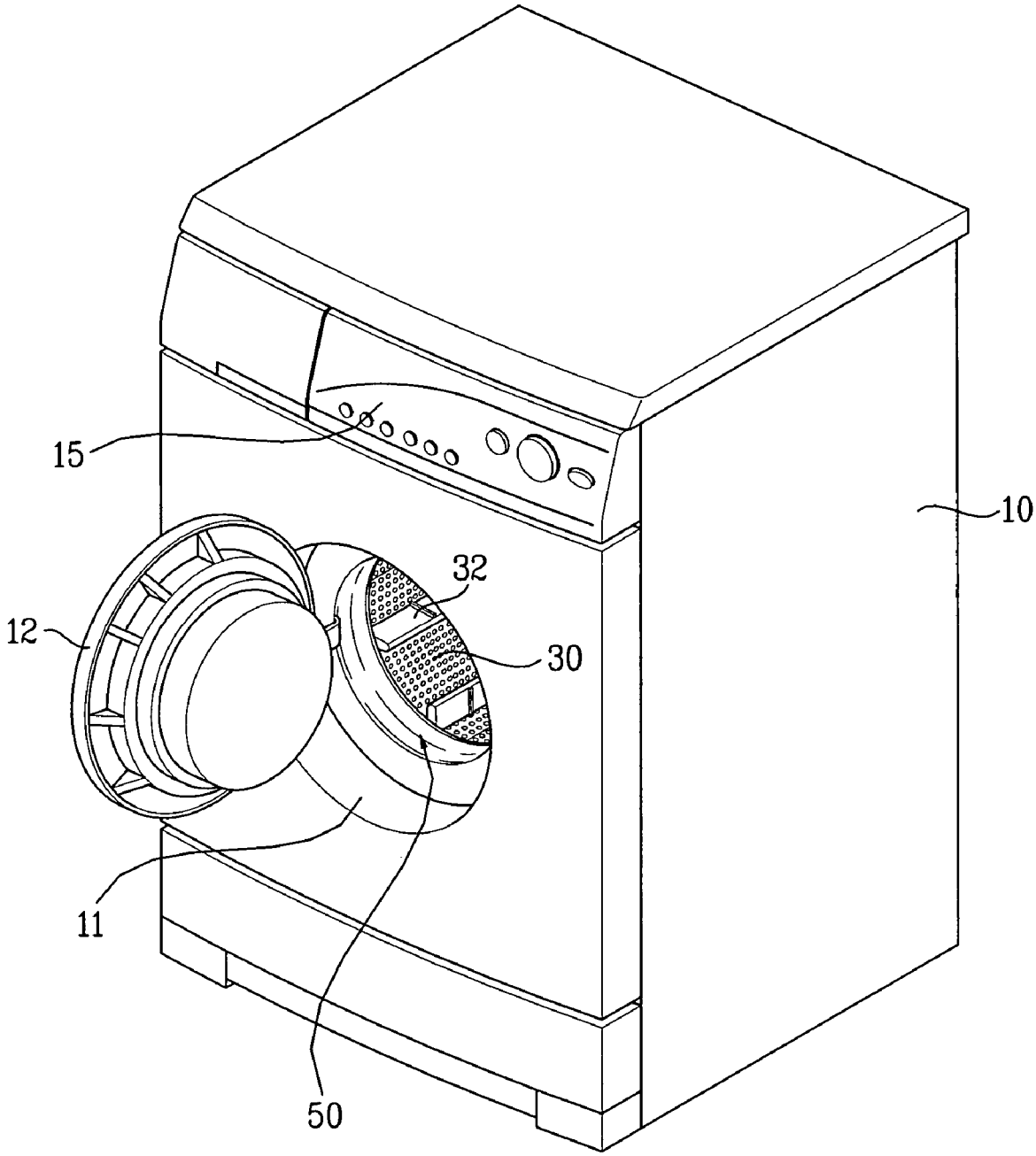
FIG. 1 is a perspective view of a general drum type washing machine.
Figure 2:
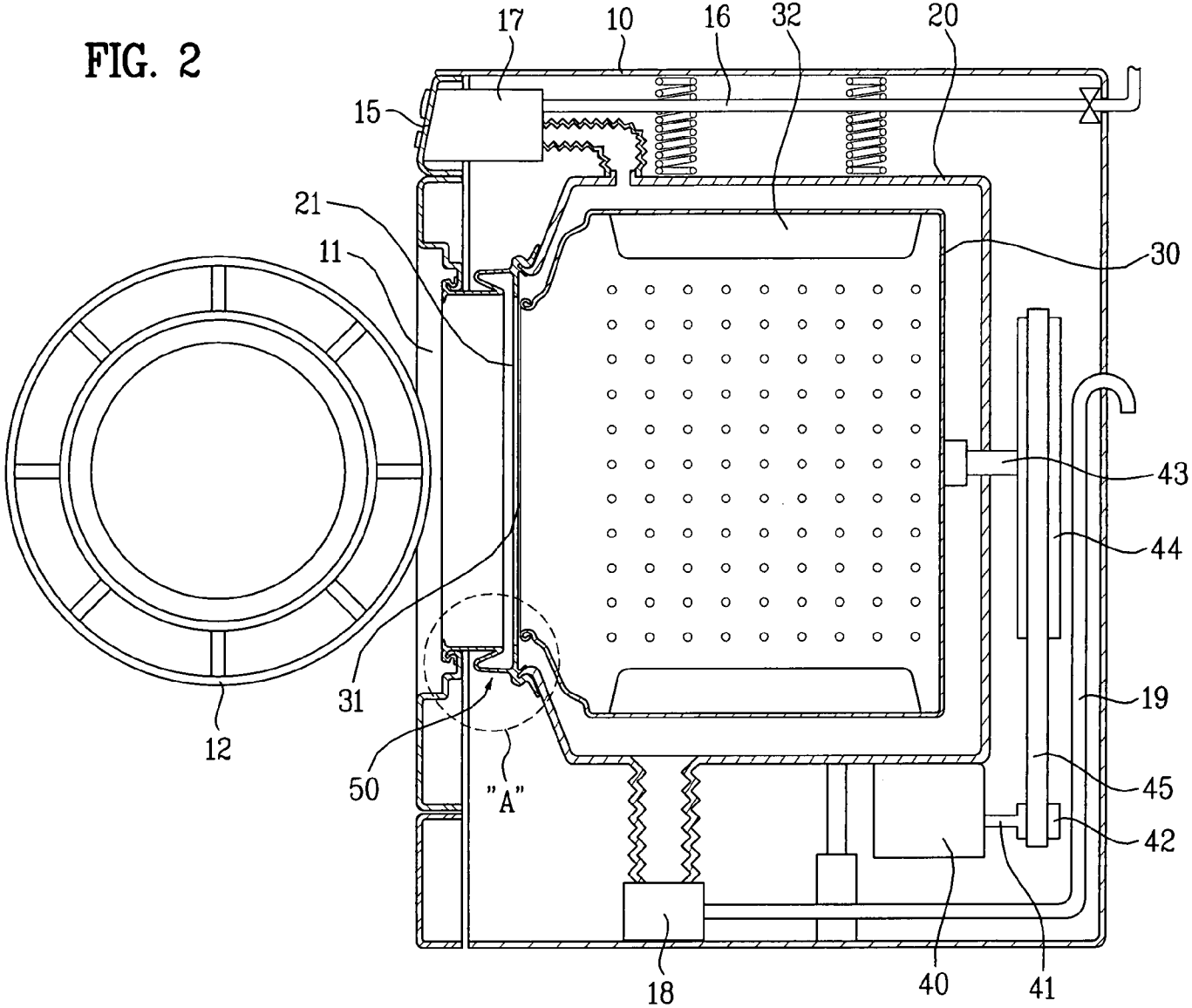
FIG. 2 is a schematic internal view of a general drum type washing machine.
Figure 3:
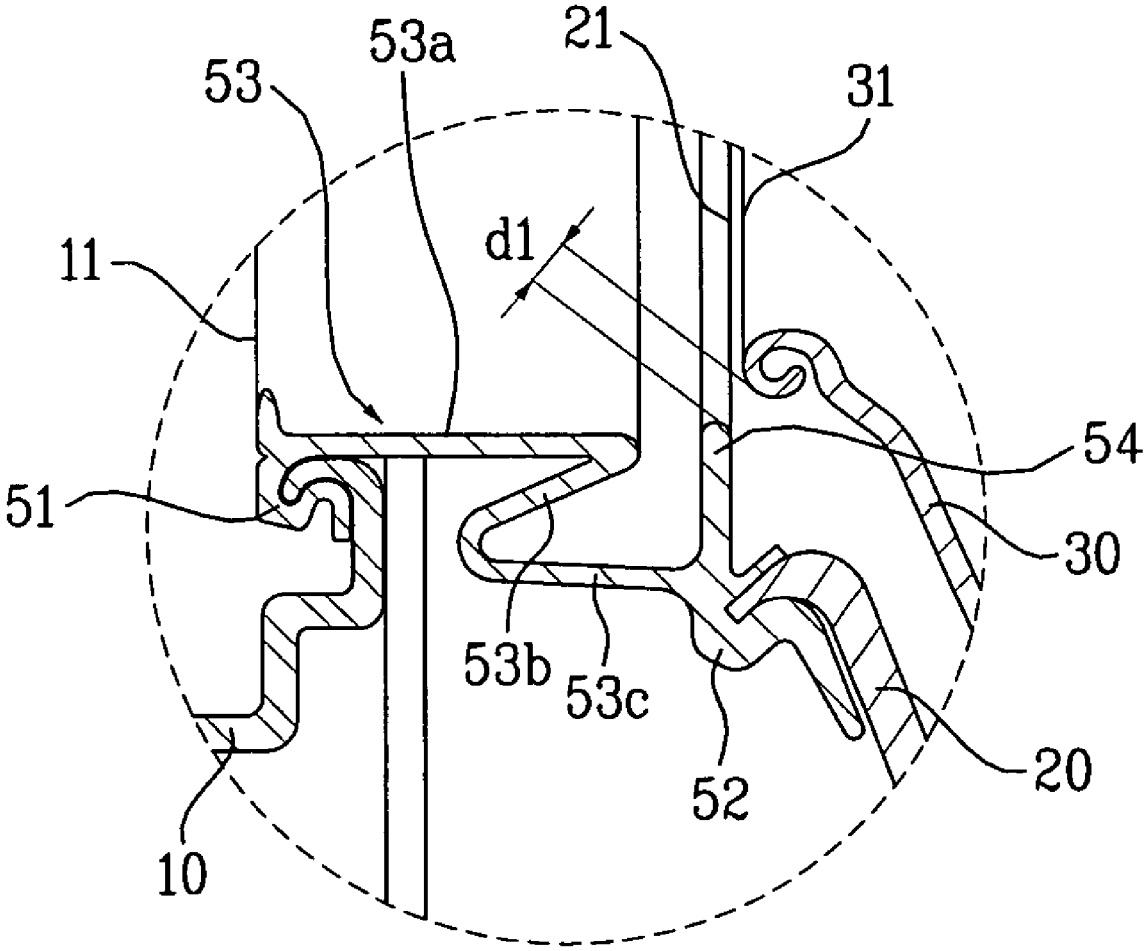
FIG. 3 is a magnified view of 'A' in FIG. 2.
Figure 4:
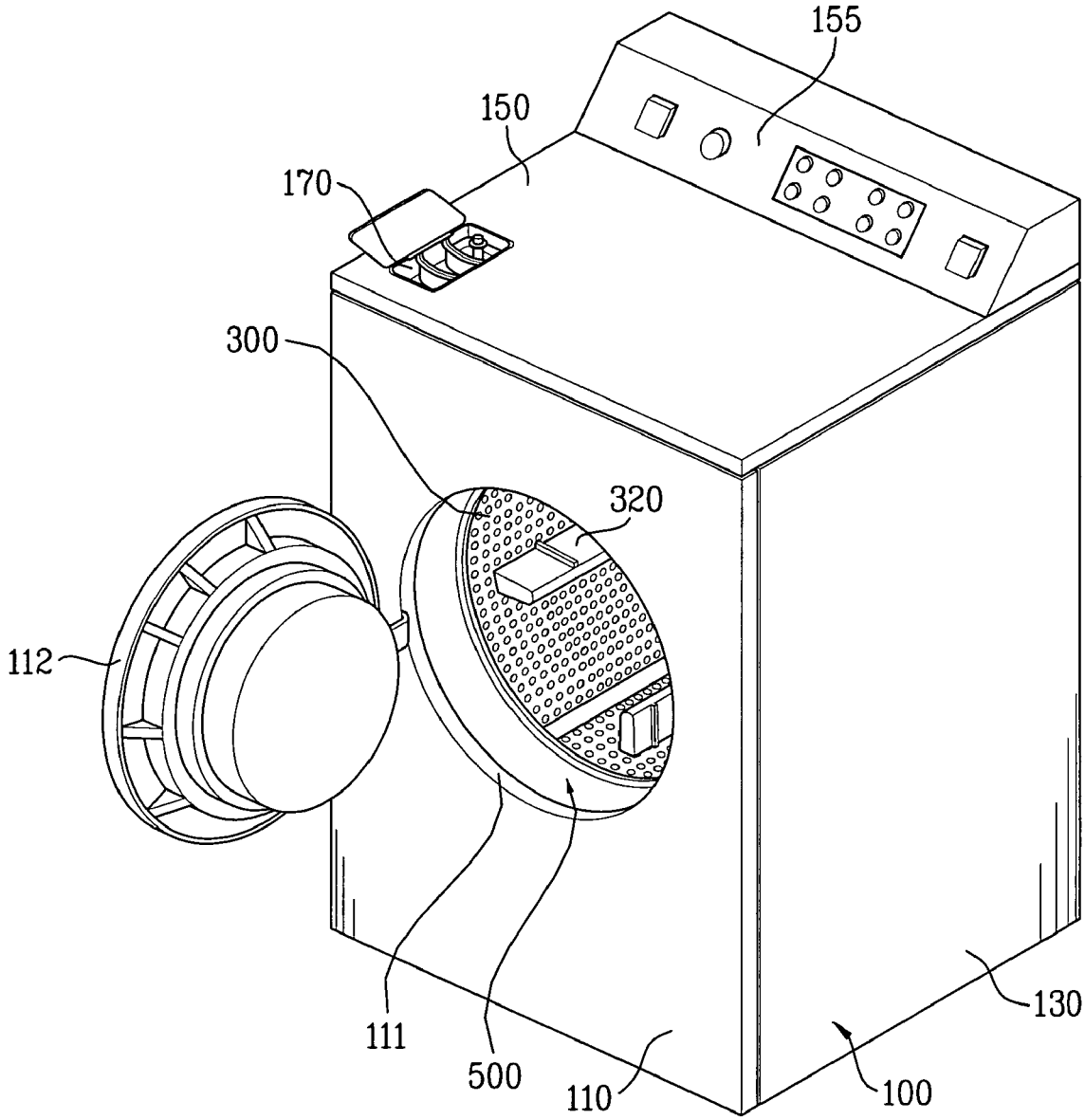
FIG. 4 is a perspective view of a drum type washing machine according to the present invention.
Figure 5:
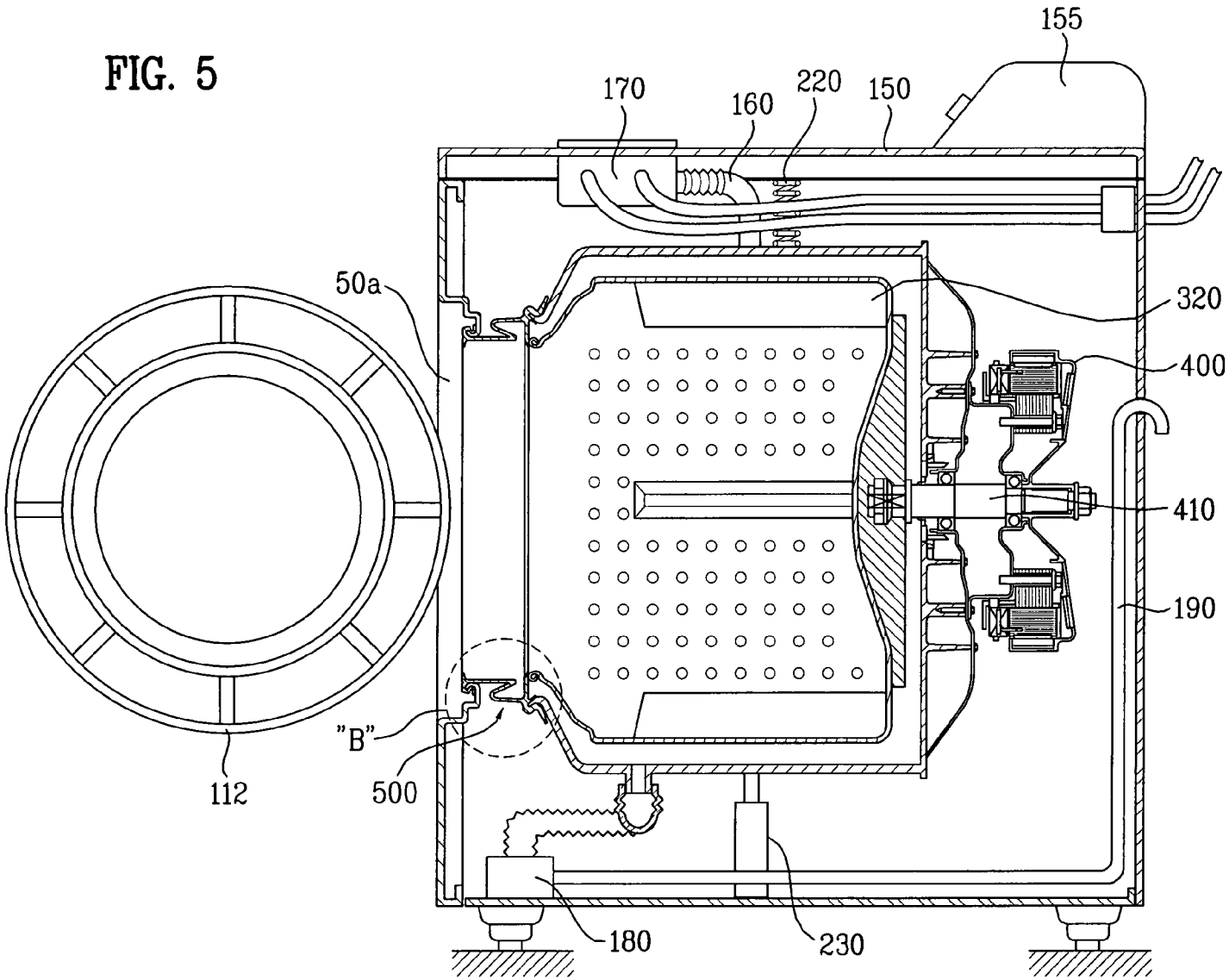
FIG. 5 is a schematic internal view of a drum type washing machine according to one embodiment of the present invention.
Figure 6:
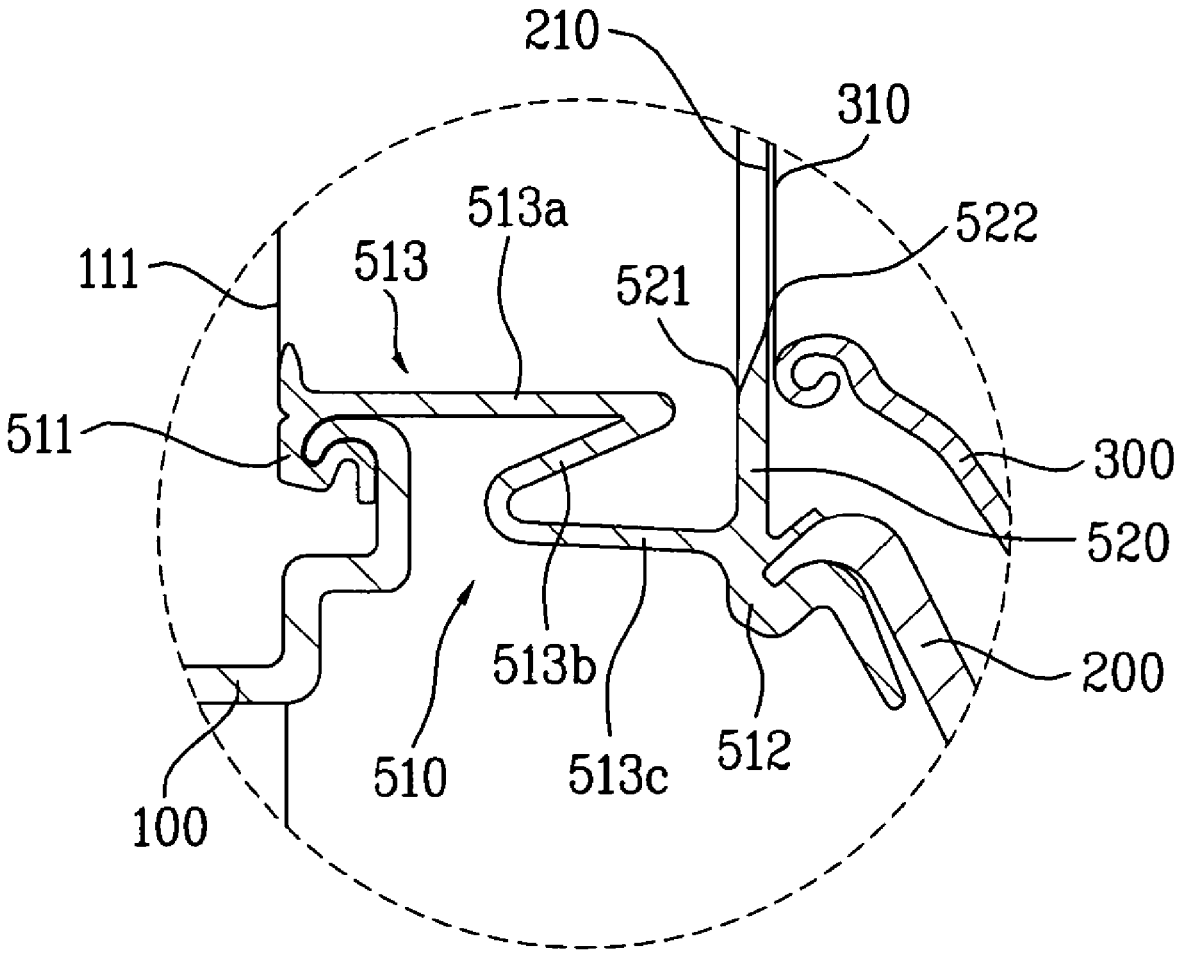
FIG. 6 is a magnified view of 'B' in FIG. 5.

FIG. 4 is a perspective view of a drum type washing machine according to the present invention, FIG. 5 is a schematic internal view of a drum type washing machine according to one embodiment of the present invention, and FIG. 6 is a magnified view of 'B' in FIG. 5.

Referring to FIG. 4 and FIG. 5, a drum type washing machine according to one preferred embodiment of the present invention includes a cabinet 100 forming an exterior, a tub 200 provided in the cabinet, a drum 300 rotatably provided in the tub, and a rotation means for rotating the drum.

The cabinet includes a base plate 120 installed at a bottom, a pair of side plates provided on both sides of the bas plate 120, a rear plate 140 provided in rear of the side plates, a front plate 110 provided in front of the base and side plates, and a top plate 150 provided on the side, rear, and front plates.

A first opening 111 through which a laundry is put in/out is formed at a center of the front plate 110. And, a door 112 is installed at the front plate 110 to open/close the first opening 111 and to prevent the laundry from being thrown away through the first opening 111.

A gasket 500 is installed between the door 112 and the tub 200 to alleviate a shock generated from rotation of the drum 300 and to play a role of a packing for preventing water from leaking outside.

A control panel 155 controlling an operation of the drum type washing machine is installed on the top plate 150.

A second opening 210 is formed at a front side of the tub 200 to correspond to the first opening 111 of the front plate 110 and to communicate with the first opening 111.

And, an elastic means 220 and a damper 230 are formed over and under the tub 200, respectively to attenuate a vibration generated from an operation of the washing machine.

The drum 300 includes lifters 320 on its inside to pull up the laundry to a predetermined height and a third opening 310 at its front side to correspond to the second opening 210.

Once the drum 300 rotates, the laundry is firstly lifted up to an upper part of the drum by the lifters 320 and then falls downward to perform washing.

And, the third opening 310 is provided as an entrance through which the laundry having put in via the first and second openings 111 and 210 finally enters the drum 300.

And, the rotation means includes a motor 400 provided in rear of the tub and a rotational shaft 410 extending from the motor 400 to be connected to the rear of the drum.

Moreover, a water supply hose 160, a water supply valve (not shown in the drawing), and a detergent box 170 for supplying water and detergent to the tub 20 are installed in an upper side of the cabinet 10. And, a drain pump 180 and a drain hose 190 for circulating or draining the water are installed at one side under the tub 200.

The gasket 500 according to one embodiment of the present invention is explained in detail by referring to FIG. 6 as follows.

The gasket 500 blocks a gap between the first and second openings 111 and 210 to prevent leakage of the water as well as another gap between the second and third openings 210 and 310 to prevent particles from being put between the tub and drum 200 and 300.

Specifically, the gasket 500 includes a leakage preventing part 510 preventing the water from leaking between an inside of the cabinet and tub 100 and 200 from the tub 200 and a ring type protrusion 520 preventing particles from being put between the drum and tub 300 and 200.

The leakage preventing part 510 includes one end enclosing a rim of the first opening 111 and the other end enclosing a rim of the second opening 210.

Specifically, the leakage preventing part 510 includes a front end coupling part 511 enclosing the first opening 111 to be coupled with the first opening, a rear end coupling part 512 enclosing the second opening 210 to be coupled with the second opening, and a middle connecting part 513 of a flexible material to connect the front and rear end coupling parts 511 and 512.

The middle connecting part 513 consists of a first connecting member 513*a* having one end connected to the front end coupling part 511 to horizontally extend toward the tub, a second connecting member 513*b* having one end connected to the other end of the first connecting member 513*a* to radially extend toward the front side of the cabinet, and a third connecting member 513*c* having one end connected to the other end of the second connecting member 513*b* and having the other end connected to the rear end coupling part 512.

Thus, the middle connecting part 513 is bent to prevent shocks from appearing on the cabinet due to vibrations of the drum and tub when the washing machine is operating.

Meanwhile, an inside diameter of the second opening 210 is formed greater than that of the third opening 310.

Moreover, the second opening 210 is formed ahead of the third opening 310.

The ring type protrusion 520 protrudes toward a center between one and the other ends of the leakage preventing part 510 to block the gap between the second and third openings 210 and 310.

Specifically, the ring type protrusion 520 is formed to extend from an inside of the other end of the leakage preventing part 510 to a front end of the third opening.

And, the ring type protrusion 520 preferably has an inside diameter of its front end 521 greater than an outside diameter of the third opening 310.

In this case, the inside diameter of the front end 521 of the ring type protrusion 510 may be greater than the outside diameter of the third opening 310.

An inside diameter of the rear end 522 of the ring type protrusion is preferably formed to be smaller than an inside diameter of the third opening 310 so that the third opening 310 is unable to be seen from a front side.

Such a shape of the ring type protrusion enables the ring type protrusion to be flexibly bent against forward and reverse vibrations of the drum to prevent damage caused by friction. Further more, an upper part of the ring type protrusion 520 may be vertically bisected to be more flexible. Namely, the ring type protrusion may have a shape of a ring type chain (not shown in the drawing) having a bisected top.

An operation of the above-constructed drum type washing machine according to the present invention is explained as follows.

First of all, a user opens the door 112, puts an appropriate amount of laundry in the drum 300 via the first opening 111, closes the door 112, puts water and detergent, selects an appropriate washing course, and then initiates an operation of a washing step.

In this case, the laundry having been put in the drum 300 is repeatedly lifted up and falls down so that the washing is performed.

After completion of the washing step, a dewatering step is executed. The dewatering step is performed in a manner that the drum 300 rotates a high speed to separate water contents from the laundry by a centrifugal force.

Meanwhile, if the user chanced to put some particles such as coins and the like into the drum 300 together with the laundry, the particles may escape from the drum 300 through the third opening 310. Yet, since the ring type protrusion 520 blocks the gap between the second and third openings 210 and 310, it is able to prevent the particles from entering the gap.

Accordingly, the present invention has the following advantages or effects.

First of all, since the ring type protrusion of the gasket blocks the gap between the second and third openings, the present invention prevents the particles from entering the gap, thereby keeping the inside of the drum type washing machine safe from the damage.

Secondly, the ring type protrusion of the gasket has a shape enabling to be flexibly bent, whereby endurance of the gasket is enhanced.

Thirdly, the gap between the third and second openings is not externally exposed, whereby a beauty of exterior is improved.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a washing machine including a cabinet having a first opening through which laundry is put in at a cabinet front side, a tub having a second opening at a tub front side, and a drum rotatably provided in the tub to have a third opening at a drum front side, a gasket comprising:

a leakage preventing part having one end connected to a rim of the first opening and the other end connected to a rim of the second opening; and a ring protrusion protruding toward a center of the third opening between the one and the other ends of the leakage preventing part to block a gap between the second and third openings, the ring protrusion having a front end defining a front end opening and a rear end defining a rear end opening, with the rear end being closer to the drum than the front end, and a diameter of the front end of the protrusion being greater than a diameter of the rear end opening of the protrusion.

2. The gasket as claimed in claim 1, wherein the protrusion extends to a front end of the third opening from an inside of the leakage preventing part.

3. The gasket as claimed in claim 1, wherein an inside diameter of the second opening is greater than that of the third opening.

4. The gasket as claimed in claim 3, wherein the second opening is formed ahead of the third opening.

5. The gasket as claimed in claim 4, wherein the protrusion extends to a front end of the third opening from an inside of the other end of the leakage preventing part.

6. The gasket as claimed in claim 1, wherein the diameter of the front end opening of the protrusion is equal to an outside diameter of the third opening.

7. The gasket as claimed in claim 1, wherein the diameter of the front end opening of the protrusion is greater than the outside diameter of the third opening.

8. The gasket as claimed in claim 1, wherein the diameter of the rear end opening of the protrusion is smaller than the inside diameter of the third opening.

9. A drum washing machine comprising:

a cabinet having a first opening through which laundry is put in at a cabinet front side;

a tub having a second opening at a tub front side; a drum provided in the tub to have a third opening at a drum front side corresponding to the second opening;

a rotation means having a rotational shaft penetrating a rear side of the tub to be connected to the drum;

a door opening/closing the first opening; and a gasket blocking a gap between the first and second openings to prevent leakage of water and blocking a gap between the second and third openings to prevent a particle from being put between the tub and the drum, the gasket including:

a leakage preventing part having one end connected to a rim of the first opening and the other end connected to a rim of the second opening; and a ring protrusion protruding toward a center of the third opening between the one and the other ends of the leakage preventing part to block a gap between the second and third openings, the ring protrusion having a front end defining a front end opening and a rear end defining a rear end opening, with the rear end being closer to the drum than the front end, and a diameter of the front end of the protrusion being greater than a diameter of the rear end opening of the protrusion.

10. The drum washing machine as claimed in claim 9, wherein the protrusion extends to a front end of the third opening from an inside of the leakage preventing part.

11. The drum washing machine as claimed in claim 9, wherein an inside diameter of the second opening is greater than that of the third opening.

12. The drum washing machine as claimed in claim 11, wherein the second opening is formed ahead of the third opening.

13. The drum washing machine as claimed in claim 12, wherein the protrusion extends to a front end of the third opening from an inside of the other end of the leakage preventing part.

14. The drum washing machine as claimed in claim 9, wherein the diameter of the front end opening of the protrusion is equal to an outside diameter of the third opening.

15. The drum washing machine as claimed in claim 9, wherein the diameter of the front end opening of the protrusion is greater than the outside diameter of the third opening.

16. The drum washing machine as claimed in claim 9, wherein the diameter of the rear end opening of the protrusion is smaller than the inside diameter of the third opening.

17. The gasket as claimed in claim 1, wherein the front and rear ends are substantially normal to a center axis of the drum.

18. The drum washing machine as claimed in claim 9, wherein the front and rear ends are substantially normal to a center axis of the drum.

* * * * *